US005694033A

United States Patent [19]

Wei et al.

[11] Patent Number: 5,694,033

[45] Date of Patent: Dec. 2, 1997

[54] LOW VOLTAGE CURRENT REFERENCE CIRCUIT WITH ACTIVE FEEDBACK FOR PLL

[75] Inventors: Shuran Wei, St. Paul; Alan Fiedler, Minneapolis; Paul Torgerson, Inver Grove Heights, all of Minn.

[73] Assignee: LSI Logic Corporation, Milpitas, Calif.

[21] Appl. No.: 709,100

[22] Filed: Sep. 6, 1996

[51] Int. Cl.[6] ..... G05F 3/16

[52] U.S. Cl. ..... 323/315; 323/316

[58] Field of Search ..... 323/315, 316; 327/541

[56] References Cited

U.S. PATENT DOCUMENTS

| | | | |
|---|---|---|---|
| 4,890,052 | 12/1989 | Hellums | 323/315 |
| 5,029,295 | 7/1991 | Bennett et al. | 323/316 |
| 5,245,273 | 9/1993 | Greaves et al. | 323/315 |
| 5,532,579 | 7/1996 | Park | 323/316 |
| 5,563,503 | 10/1996 | Ng et al. | 323/315 |
| 5,627,456 | 5/1997 | Novof et al. | 323/315 |

OTHER PUBLICATIONS

J. Alvarez, H. Sanchez, G. Gerosa, and R. Countryman, "A Wide-Bandwidth Low-Voltage PLL for PowerPC™ Microprocessors," *IEEE Journal of Solid-State Circuits*, vol. 30, No. 4, Apr. 1995, pp. 385–391.

*Primary Examiner*—Stuart N. Hecker

*Attorney, Agent, or Firm*—Westman, Champlin & Kelly, P.A.

[57] ABSTRACT

A current reference circuit includes a first, current mirror transistor having a gate coupled to a first feedback node, a source coupled to a first supply terminal and a drain forming a first reference node. A second, current mirror transistor has a gate coupled to the first feedback node, a source coupled to the first supply terminal and a drain forming a second reference node. A third transistor has a gate coupled to a second feedback node, a source coupled to a second supply terminal and a drain coupled to the first reference node. A fourth transistor has a gate coupled to the second feedback node, a source coupled to the second supply terminal and a drain coupled to the second reference node. A first operational amplifier has a first input coupled to the first reference node, a second input coupled to a bias node and an output forming the first feedback node. A second operational amplifier has a first input coupled to the second reference node, a second input coupled to the bias node and an output forming the second feedback node. The operational amplifiers are active elements which allow the current reference circuit to operate at a very low voltage and have a very low sensitivity to changes in the supply voltage.

7 Claims, 4 Drawing Sheets

LOW VOLTAGE CURRENT REFERENCE CIRCUIT WITH ACTIVE FEEDBACK FOR PLL

BACKGROUND OF THE INVENTION

The present invention relates to current reference circuits and, in particular, to a current reference circuit having a low power supply sensitivity and which operates with a very low power supply voltage.

Current reference circuits are used in many applications, including phase locked loops (PLLs). Current reference circuits preferably operate at a low voltage and preferably provide a reference current which is relatively insensitive to changes in the supply voltage. Advancements in semiconductor integrated circuit fabrication technology enable the geometries of circuit devices to be progressively reduced so that more devices can fit on a single integrated circuit. Power supply voltages are being reduced to reduce overall power consumption and to prevent damage to the devices having small feature sizes. For example, power supplies are now being reduced from 5.0 volts to 3.3 volts and from 3.3 volts to 2.5 volts and below.

Reducing the power supply voltage presents a challenge when implementing traditional circuit configurations, such as a current reference circuit since the supply voltage must be large enough to provide for the necessary threshold voltages of the transistors in the circuit. G. Alvared et al., "A Wide-Bandwidth Low-Voltage PLL for PowerPC™ Microprocessors," IEEE J. Solid-State Circuits, Vol. 30, No. 4, pp. 383–92 (April 1995), discloses a current reference circuit formed of a pair of ratioed P+ to nwell diodes, a pair of ratioed NMOS transistors, a PMOS current mirror load and a start-up circuit. Although this current reference circuit has several advantages, it has a relatively large sensitivity to changes in supply voltage and requires a supply voltage of higher than 2.0 volts. Therefore, the circuit cannot be used with recent advanced process technologies which require supply voltages of less than 2.0 volts.

There is a continuing need for improved current reference circuits having low sensitivity to changes in supply voltage and which operate with very low supply voltages.

SUMMARY OF THE INVENTION

The current reference circuit of the present invention includes a first current mirror transistor having a gate coupled to a first feedback node, a source coupled to a first supply terminal and a drain forming a first reference node. A second, current mirror transistor has a gate coupled to the first feedback node, a source coupled to the first supply terminal and a drain forming a second reference node. A third transistor has a gate coupled to a second feedback node, a source coupled to a second supply terminal and a drain coupled to the first reference node. A fourth transistor has a gate coupled to the second feedback node, a source coupled to the second supply terminal and a drain coupled to the second reference node. A first operational amplifier has a first input coupled to the first reference node, a second input coupled to a bias node and an output forming the first feedback node. A second operational amplifier has a first input coupled to the second reference node, a second input coupled to the bias node and an output forming the second feedback node.

In one embodiment, the current reference circuit further includes a bias generator having a fifth, current mirror transistor and a sixth, bias transistor. The fifth, current mirror transistor has a gate coupled to the first feedback node, a source coupled to the first supply terminal and a drain. The sixth, bias transistor has a gate and a drain coupled to the drain of the fifth, current mirror transistor and to the bias node and has a source coupled to the second supply terminal. The sixth, bias transistor sets the voltage on the bias node and thereby sets the operating state of the current reference circuit.

The operational amplifiers are active feedback elements which allow the current reference circuit to operate at a very low supply voltage and have a very low input offset sensitivity to changes in the supply voltage. When the supply voltage increases, the voltages on the first and second reference nodes tend to increase slightly relative to the voltage on the bias node. The operational amplifiers sense the difference in voltage and adjust the voltages on the feedback nodes to adjust the operating states of the first and second mirror transistors and thereby restore the voltages on the first and second reference nodes.

DETAILED DESCRIPTION OF THE PREFERRED EMBODIMENTS

Figure 1:
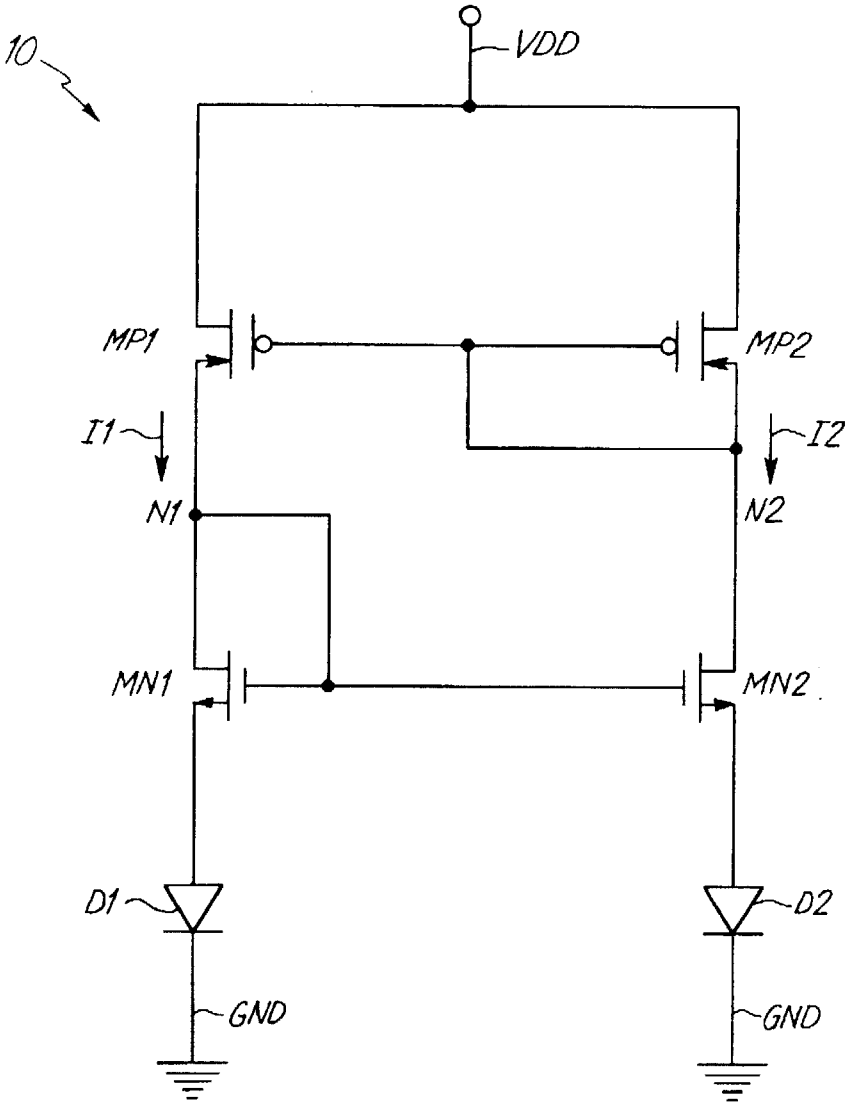
Fig. 1 PRIOR ART
FIG. 1 is a schematic diagram of a current reference of the prior art.

FIG. 1 is a schematic diagram of a current reference circuit of the prior art. Current reference circuit 10 includes voltage supply terminals VDD and GND, PMOS current mirror load transistors MP1 and MP2, a pair of ratioed NMOS transistors MN1 and MN2, and a pair of diodes D1 and D2. Transistors MP1 and MP2 are coupled together to form a current mirror which generates substantially equal currents I1 and I2 through nodes N1 and N2, respectively. Transistors MN1 and MN2 are ratioed with respect to one another such that the gate length of transistor MN1 is greater than the gate length of transistor MN2, and/or the gate width of transistor MN2 is greater than the gate width of transistor MN1. A start-up circuit (not shown) injects a current into node N1 to initiate current flowing in the reference circuit. A further current mirror transistor can be coupled to transistors MN1 and MN2 to mirror either current I1, or I2 to an output stage as a reference current.

Current reference circuit 10 requires a relatively large minimum supply voltage to turn on the transistors in the circuit. The minimum turn on voltage at the gate of transistor MP2 is, $$V_{GS,MP2,MIN} = V_{T,MP2} + V_{DS,SAT,MP2} \qquad \text{EQ. 1}$$

Where $V_{T,MP2}$ is the gate to source threshold voltage of transistor MP2 and $V_{DS,SAT,MP2}$ is the drain to source saturation voltage of transistor MP2.

Looking at the voltage drops in the right hand branch of the circuit, the minimum supply voltage $VDD_{MIN}$ required to turn on transistor MP2 and thus operate the branch equals the gate to source voltage $V_{GS,MP2,MIN}$ of transistor MP2 plus the drain to source saturation voltage, $V_{DS,SAT,MN2}$ of transistor MN2 plus the voltage drop $V_{D2}$ across diode D2. Therefore, substituting the right-hand side of Equation 1 for $V_{GS,MP2,MIN}$, $$VDD_{MIN}=V_{DS,SAT,MP2}+V_{T,MP2}+V_{DS,SAT,MN2}+V_{D2} \quad \text{EQ. 2}$$

Which, in one embodiment, result in, $$VDD_{MIN}=0.3+0.9+0.3+0.5=2.0 \quad \text{EQ. 3}$$

Since the minimum supply voltage is 2.0 volts, current reference circuit 10 shown in FIG. 1 cannot be used in advanced fabrication processes which have supply voltages lower than 2.0 volts.

Also, current reference circuit 10 is relatively sensitive to changes in supply voltage. The voltage on reference node N2 tends to follow changes in VDD, which creates an imbalance between the voltages at nodes N1 and N2, and thus the currents through diodes D1 and D2. For example, currents I1 and I2 may change by up to 50% per volt change in the supply voltage.

Figure 2:
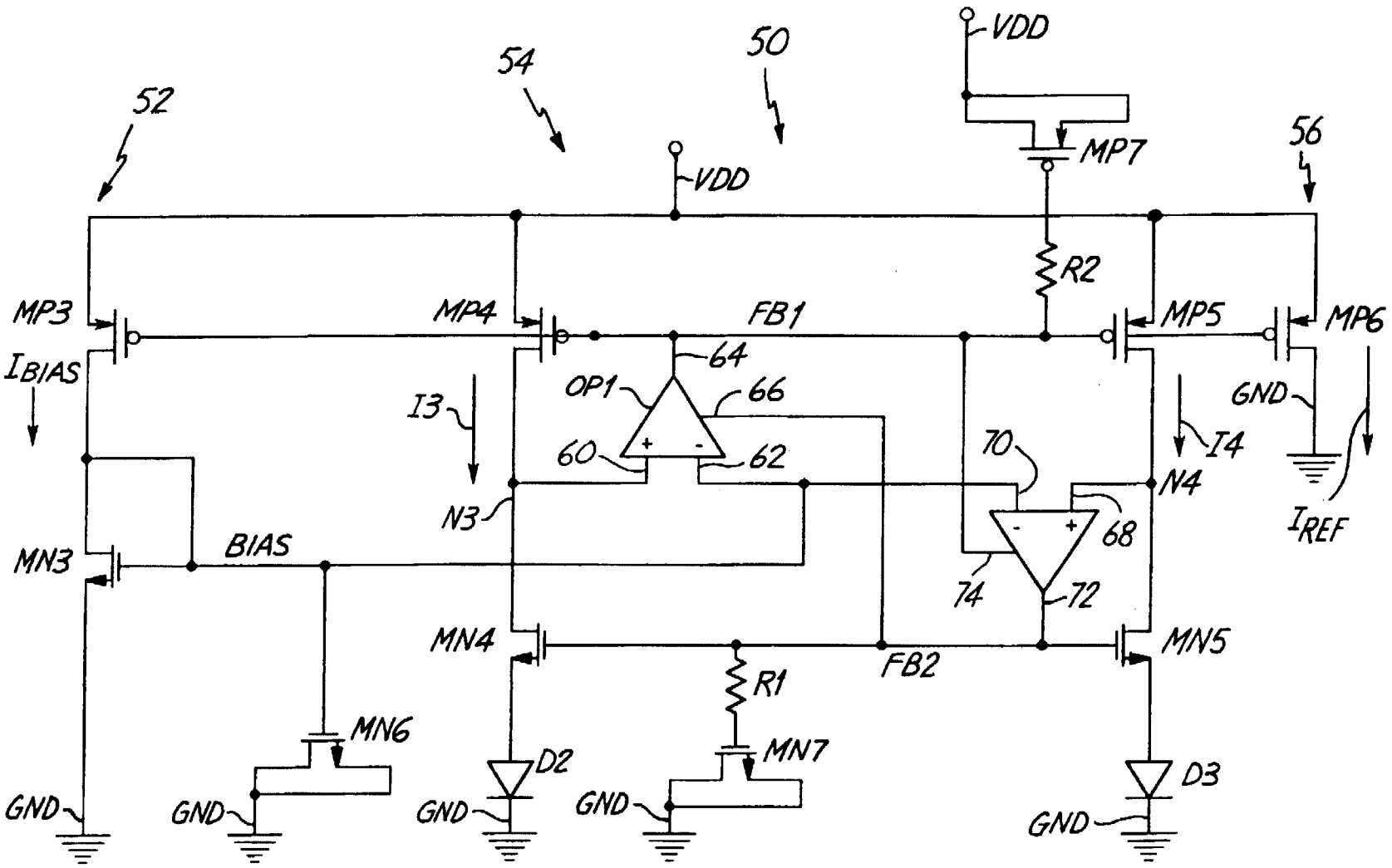
FIG. 2 is a schematic diagram of a current reference circuit according to the present invention.

FIG. 2 is a schematic diagram of a current reference circuit 50 according to the present invention. Current reference circuit 50 includes a bias generator 52, a reference generator 54 and an output circuit 56. Bias generator 52 includes P-channel current mirror transistor MP3 and N-channel bias transistor MN3. Current mirror transistor MP3 has a source coupled to supply terminal VDD, a gate coupled to a feedback node FB1 and a drain coupled to the drain and gate of bias transistor MN3. The source of bias transistor MN3 is coupled to voltage supply terminal GND. The drain of current mirror transistor MP3 generates a bias current $I_{BIAS}$ which flows through bias transistor MN3, which generates a bias voltage $V_{BIAS}$ on bias node BIAS. The voltage on bias node BIAS sets the operating state of reference generator 54.

Reference generator 54 is similar to the circuit shown in FIG. 1 in that the generator includes P-channel current mirror transistors MP4 and MP5, N-channel transistors MN4 and MN5 and diodes D2 and D3. However, N-channel transistors MN4 and MN5 are not required to be ratioed in the same manner as transistors MN1 and MN2 and current generator 54 further includes operational amplifiers OP1 and OP2 which provide active feedback for current mirror transistors MP4 and MP5 and for transistors MN4 and MN5, respectively. Current mirror transistor MP4 has a gate coupled to feedback node FB1, a source coupled to supply terminal VDD and a drain coupled to reference node N3. Current mirror transistor MP5 has a gate coupled to feedback node FB1, a source coupled to supply terminal VDD and a drain coupled to reference node N4. Transistor MN4 has a gate coupled to feedback node FB2, a source coupled to diode D2 and a drain coupled to reference node N3. Diode D2 is coupled between the source of transistor MN4 and supply terminal GND. Transistor MN5 has a gate coupled to feedback node FB2, a source coupled to diode D3 and a drain coupled to reference node N4. Diode D3 is coupled between the source of transistor MN5 and supply terminal GND.

Operational amplifier OP1 has a first input 60 coupled to reference node N3, a second input 62 coupled to bias node BIAS, an output 64 coupled to feedback node FB1 and a reference voltage input 66 coupled to feedback node FB2. Operational amplifier OP2 has a first input 68 coupled to reference node N4, a second input 70 coupled to bias node BIAS, an output 72 coupled to feedback node FB2 and a reference voltage input 74 coupled to feedback node FB1.

Output circuit 56 includes a P-channel current mirror transistor MP6 having a gate coupled to feedback node FB1, a source coupled to supply terminal VDD and a drain coupled to supply terminal GND. Current $I_3$ is mirrored into the drain of current mirror transistor MP6 as reference current $I_{REF}$.

Current reference circuit 50 further includes transistor MN6 having its gate coupled to bias node BIAS and its source and drain coupled to supply terminal GND. Transistor MN6 provides a filter for bias node BIAS. Resistor R1 and N-channel transistor MN7 provide frequency compensation for feedback node FB2. Resistor R1 is coupled between feedback node FB2 and the gate of N-channel transistor MN7. The source and drain of N-channel transistor MN7 are coupled to supply terminal GND. Similarly, resistor R2 and P-channel transistor MP7 provide frequency compensation for feedback node FB1. Resistor R2 is coupled between feedback node FB1 and the gate of P-channel transistor MP7. The source and drain of P-channel transistor MP7 are coupled to supply terminal VDD. In a preferred embodiment, all transistors in current reference circuit 50 are implemented in metal oxide field-effect semiconductor transistor (MOSFET) technology.

During operation, operational amplifiers OP1 and OP2 receive bias voltage $V_{BIAS}$ on bias node BIAS at inputs 62 and 70, respectively and adjust the voltages on feedback nodes FB1 and FB2 until the voltages on reference nodes N3 and N4, and thus inputs 60 and 72, are substantially equal to bias voltage $V_{BIAS}$. Increasing or decreasing the voltages on feedback nodes FB1 and FB2 changes the operating states of transistors MP4 and MN5, which changes the drain-source voltage drops across transistors MP4 and MN5 and thus the voltages on reference nodes N3 and N4.

The use of operational amplifier OP1 as an active feedback for the current mirror formed by current mirror transistors MP4 and MP5 allows current reference circuit 50 to have a very low sensitivity to changes in supply voltage VDD. If supply voltage VDD increases, operational amplifier OP1 will hold the voltage on reference node N3 equal to the voltage on bias node BIAS by adjusting the voltage applied to feedback node FB1. Similarly, operational amplifier OP2 holds the voltage on reference node N4 equal to the voltage on bias node BIAS by adjusting the voltage on feedback FB2 to thereby adjust the operating state of transistor MN5 and thereby adjusting the voltage drop across the transistor. Therefore, the voltages on reference nodes N3 and N4 do not follow changes in the supply voltage VDD. In the embodiment shown in FIG. 2, the current through nodes N3 and N4 vary only 0.02% for each one volt change in supply voltage VDD.

Increasing or decreasing the voltage of feedback node FB1 has the same effect on the operation of current mirror transistors MP3, MP5 and MP6. The bias voltage supplied by bias transistor MN3 is therefore also insensitive to changes in supply voltage VDD. As supply voltage VDD increases, operational amplifier OP1 adjusts the voltage on feedback node FB1, which adjusts the operating state of transistor MP3 in a similar manner as transistor MP4, to thereby maintain the bias voltage on bias node BIAS.

Another advantage of the current reference circuit shown in FIG. 2 is that the circuit can operate with a very low supply voltage VDD. As shown in FIG. 2, current mirror transistor MP5 does not have its gate coupled to its drain as is the case with transistor MP2 in the circuit shown in FIG. 1. Therefore, the threshold voltage of transistor MP5 is not added to the minimum supply voltage VDD. Looking at the right hand branch of the circuit shown in FIG. 2, the minimum supply voltage is, $$\text{i } VDD_{MIN}=V_{DS,SAT,MP5}+V_{DS,SAT,MN5}+V_{D3} \quad \text{EQ. 4}$$

Where $V_{DS,SAT,MP5}$ and $V_{DS,SAT,MN5}$ are the drain to source saturation voltages of transistors MP5 and MN5, respectively, and $V_{D3}$ is the voltage drop across diode D3. In one embodiment, this results in, $$VDD_{MIN}=0.3V+0.3V+0.5V=1.1V \quad \text{EQ. 5}$$

The current reference circuit shown in FIG. 2 therefore has a much lower minimum supply voltage than does the circuit shown in FIG. 1.

The following tables provide examples of gate lengths and gate widths of the transistors shown in FIG. 2 according to one embodiment of the present invention:

| Transistor | Length (Microns) | Width (microns) |
|---|---|---|
| MP3 | 5 | 20 |
| MP4 | 5 | 20 |
| MP5 | 5 | 20 |
| MP6 | 5 | 20 |
| MP7 | 5 | 20 |
| MN3 | 10 | 6 |
| MN4 | 5 | 12 |
| MN5 | 5 | 12 |
| MN6 | 5 | 12 |
| MN7 | 5 | 12 |

Figure 3:
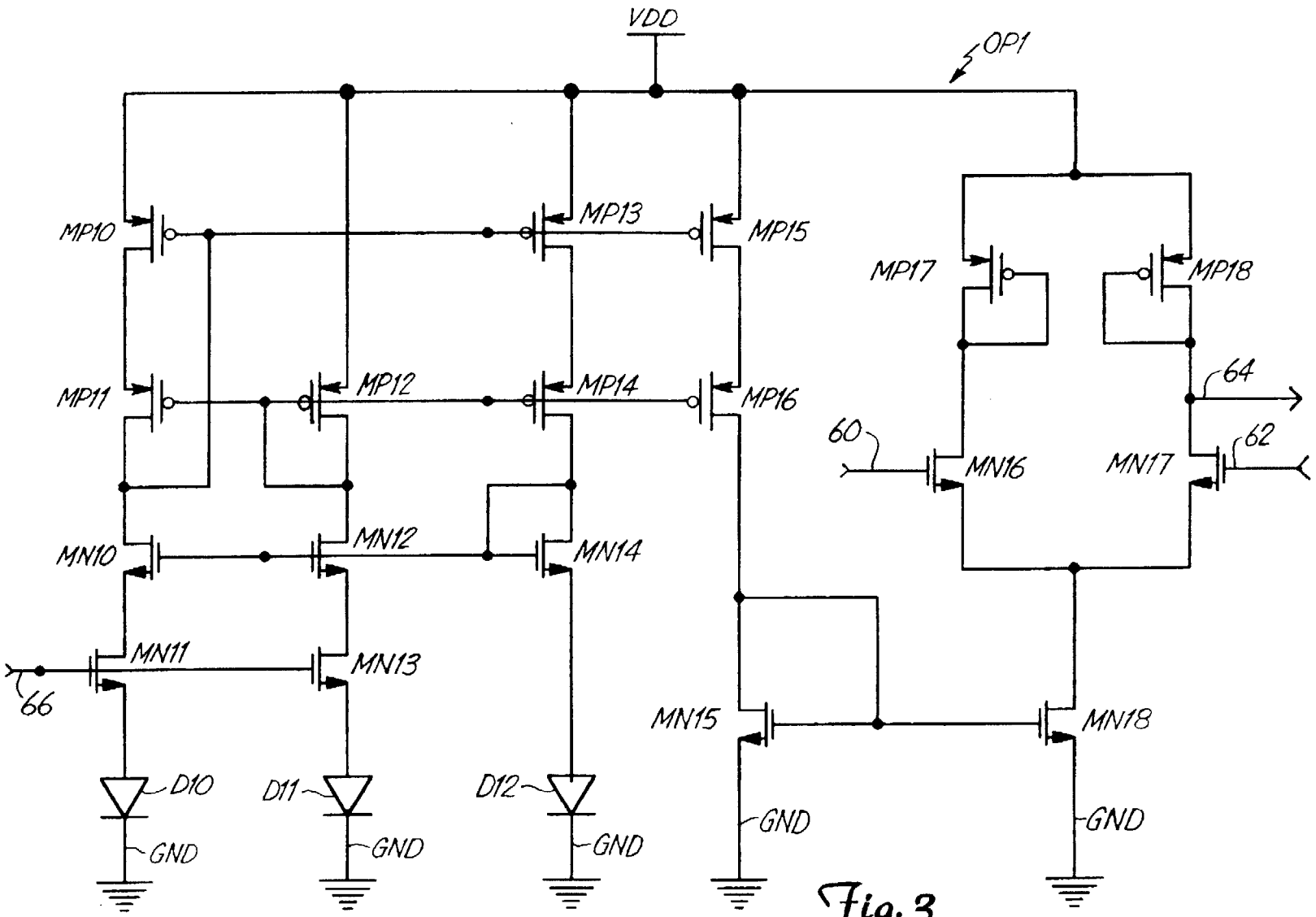
FIG. 3 is a schematic diagram of an operational amplifier used in the current reference circuit shown in FIG. 2.

FIG. 3 is a schematic diagram of operational amplifier OP1 shown in FIG. 2. Operational amplifier OP1 includes inputs 60 and 62, output 64, reference voltage input 66, P-channel transistors MP10–MP18, N-channel transistors MN10–MN18 and diodes D10–D12. Operational amplifier OP1 receives the voltages on reference node N3 and bias node BIAS on inputs 60 and 62, respectively, and generates an output voltage on output 64 which is proportional to a difference between the voltages applied to inputs 60 and 62. Reference voltage input 66 receives the voltage on feedback node FB2, which sets the gain of operational amplifier OP1.

Figure 4:
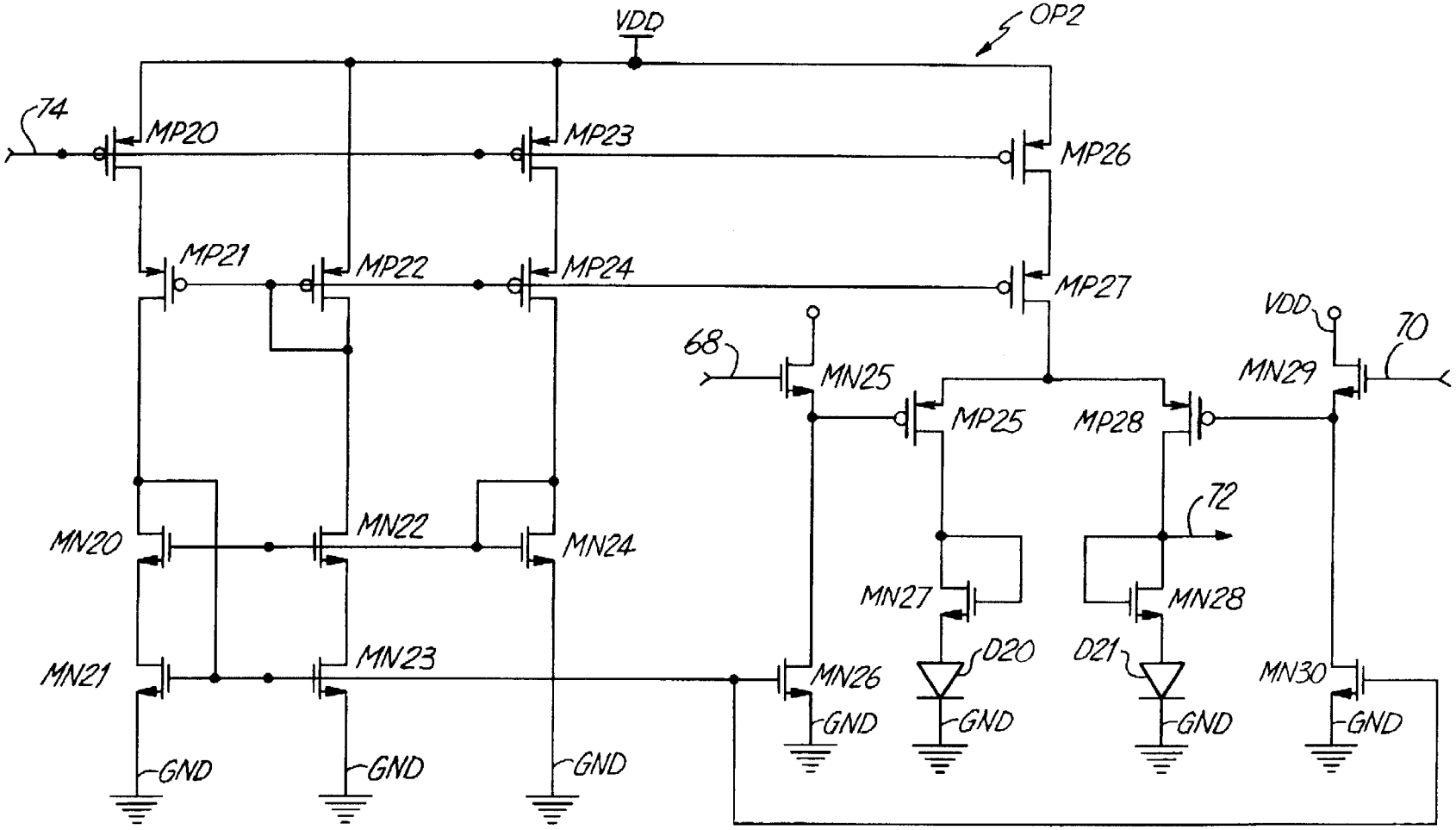
FIG. 4 is a schematic diagram of another operational amplifier used in the current reference circuit shown in FIG. 2.

FIG. 4 is a schematic diagram of operational amplifier OP2. Operational amplifier OP2 includes inputs 68 and 70, output 72, reference voltage input 74, P-channel transistors MP20–MP28, N-channel transistors MN20–MN30 and diodes D20 and D21. Input 68 is noninverting and input 70 is inverting. Operational amplifier OP2 generates an output voltage on output 72 in response to a difference between the voltages applied to inputs 68 and 70. The voltage on reference voltage input 74 sets the gain of operational amplifier OP2. The schematic diagrams shown in FIGS. 3 and 4 are shown as examples only. Various other operational amplifiers or circuit configurations can also be used in accordance with the present invention.

Although the present invention has been described with reference to preferred embodiments, workers skilled in the art will recognize that changes may be made in form and detail without departing from the spirit and scope of the invention. For example, the current reference circuit of the present invention can be implemented with various technologies other than MOSFET technology and with various circuit configurations. Also, the voltage supply terminals can be relatively positive or relatively negative, depending upon the particular convention adopted and the technology used. In addition, this circuit can be inverted by replacing the P-channel transistors with N-channel transistors replacing the N-channel transistors with P-channel transistors and making other modifications. As such, the terms "drain" and "source" used in the specifications and the claims are arbitrary terms and can be interchanged. Likewise, the term "coupled" can include various types of connections or couplings and can include a direct connection or a connection through one or more intermediate components.

What is claimed is:

1. A current reference circuit comprising:

first and second supply terminals;

a first, current mirror transistor having a gate coupled to a first feedback node, a source coupled to the first supply terminal and a drain forming a first reference node;

a second, current mirror transistor having a gate coupled to the first feedback node, a source coupled to the source of the first, current mirror transistor and a drain forming the second reference node;

a third transistor having a gate coupled to a second feedback node, a source coupled to the second supply terminal and a drain coupled to the first reference node;

a fourth transistor having a gate coupled to the second feedback node, a source coupled to the second supply terminal and a drain coupled to the second reference node;

a first operational amplifier having a first input coupled to the first reference node, a second input coupled to a bias node and an output forming the first feedback node; and a second operational amplifier having a first input coupled to the second reference node, a second input coupled to the bias node and an output forming the second feedback node.

2. The current reference circuit of claim 1 and further comprising:

a first diode coupled between the source of the third transistor and the second supply terminal; and a second diode coupled between the source of the fourth transistor and the second supply terminal.

3. The current reference circuit of claim 1 and further comprising a bias generator which comprises:

a fifth, current mirror transistor having a gate coupled to the first feedback node, a source coupled to the source of the first, current mirror transistor and a drain; and a sixth, bias transistor having a gate and drain coupled to the drain of the fifth, current mirror transistor and to the bias node and having a source coupled to the second supply terminal.

4. The current reference circuit of claim 1 wherein the third and fourth transistors have equal gate widths and equal gate lengths.

5. The current reference circuit of claim 1 wherein each of the first and second operational amplifiers has a reference voltage input which is coupled to the output of the other of the first and second operational amplifiers.

6. The current reference circuit of claim 1 and further comprising:

an output transistor having a gate coupled to the first feedback node, a source coupled to the source of the first, current mirror transistor and a drain providing a reference current output.

7. A current reference circuit comprising:

first and second supply terminals;

a bias voltage input;

a first current mirror transistor having a gate coupled to a first feedback node, a source coupled to the first supply terminal and a drain forming a first reference node;

a second current mirror transistor having a gate coupled to the first feedback node, a source coupled to the source of the first transistor and a drain forming the second reference node;

a third transistor having a gate coupled to a second feedback node, a source coupled to the second supply terminal and a drain coupled to the first reference node;

a fourth transistor having a gate coupled to the second feedback node, a source coupled to the second supply terminal and a drain coupled to the second reference node;

means for providing a first feedback voltage on the first feedback node as a function of the bias voltage input and a voltage on the first reference node; and means for providing a second feedback voltage on the second feedback node as a function of the bias voltage input and a voltage on the second reference node.

* * * * *